US005535529A

United States Patent [19]

Panteah

[11] Patent Number: 5,535,529

[45] Date of Patent: Jul. 16, 1996

[54] CUSHIONED BOOT ATTACHMENT SYSTEM FOR STALKING GAME

[76] Inventor: Loren B. Panteah, P.O. Box 682, Zuni, N.M. 87327

[21] Appl. No.: 406,469

[22] Filed: Mar. 20, 1995

[51] Int. Cl.[6] ..... A43B 3/16

[52] U.S. Cl. ..... 36/7.1 R; 36/7.5; 36/11; 36/116; 36/132; 36/71

[58] Field of Search ..... 36/7.1 R, 7.5, 36/9 R, 11, 11.5, 110, 116, 132, 136, 2 R, 71

[56] References Cited

U.S. PATENT DOCUMENTS

| | | | |
|---|---|---|---|
| 1,224,390 | 5/1917 | Lipinski | 36/50.1 X |
| 2,391,720 | 12/1945 | Ludwig | 36/11.5 X |
| 3,058,241 | 10/1962 | Rigsby | 36/11.5 X |
| 3,176,416 | 4/1965 | Seegert | 36/7.1 R |
| 3,667,140 | 6/1972 | Hunderford | 36/71 X |
| 3,875,687 | 4/1975 | Henderson | 36/7.1 R |
| 4,294,023 | 10/1981 | Banford | 36/11.5 |
| 4,896,439 | 1/1990 | Morgan | 36/116 X |
| 5,168,643 | 12/1992 | Laurain | 36/116 X |
| 5,176,624 | 1/1993 | Kuehnreich | 36/110 X |
| 5,211,672 | 5/1993 | Andujar | 36/2 R X |

*Primary Examiner*—Paul T. Sewell
*Assistant Examiner*—Marie Denise Patterson

[57] ABSTRACT

A cushioned boot attachment system for stalking game adapted for use in association with hunting boots, each boot having a heel and a toe, the apparatus including at least two attachments, each comprising: a boot sleeve formed in a generally box shaped configuration with an open top section, an open front section, and a rear wall, two side walls and a bottom wall, the walls being formed contiguously with each other and including a lining with cushioned material, a user's boot being positionable within each sleeve with the heel against the rear wall and the toe positioned through the open front section, the top section of the sleeve including a shoelace positioned therethrough, the top section including shoe lace coupling devices to facilitate tightening of the apparatus snugly around a user's feet.

2 Claims, 4 Drawing Sheets

CUSHIONED BOOT ATTACHMENT SYSTEM FOR STALKING GAME

BACKGROUND OF THE INVENTION

1. Field of the Invention

The present invention relates to a cushioned boot attachment system for stalking game and more particularly pertains to quietly stalking game by securing the sound muffling apparatus around the heel and sides of a hunter's boots.

2. Description of the Prior Art

The use of boot accessories is known in the prior art. More specifically, boot accessories heretofore devised and utilized for the purpose of enhancing the utility of boots by attaching various accessories to them are known to consist basically of familiar, expected, and obvious structural configurations, notwithstanding the myriad of designs encompassed by the crowded prior art which has been developed for the fulfillment of countless objectives and requirements.

By way of example, the prior art discloses in U.S. Pat. No. 4,735,010 to Grinarml a scent dispenser for attachment under a shoe.

U.S. Pat. No. 4,713,895 to Vallieres discloses a sports shoe cover.

U.S. Pat. No. 4,896,439 to Morgan discloses a sound proof cover for soles of sportsmen's shoes and method for use.

U.S. Pat. No. 4,893,421 to Folks discloses a hunting shoe noise suppressor.

Lastly, U.S. Pat. No. 5,168,643 to Laurain discloses sound absorbing shoes.

In this respect, the cushioned boot attachment system for stalking game according to the present invention substantially departs from the conventional concepts and designs of the prior art, and in doing so provides an apparatus primarily developed for the purpose of quietly stalking game by securing the sound muffling apparatus around the heel and sides of a hunter's boots.

Therefore, it can be appreciated that there exists a continuing need for new and improved cushioned boot attachment system for stalking game which can be used for quietly stalking game by securing the sound muffling apparatus around the heel and sides of a hunter's boots. In this regard, the present invention substantially fulfills this need.

SUMMARY OF THE INVENTION

In view of the foregoing disadvantages inherent in the known types of boot accessories now present in the prior art, the present invention provides improved cushioned boot attachment system for stalking game. As such, the general purpose of the present invention, which will be described subsequently in greater detail, is to provide new and improved cushioned boot attachment system for stalking game and method which has all the advantages of the prior art and none of the disadvantages.

To attain this, the present invention essentially comprises a new and improved cushioned boot attachment system for stalking game adapted for use in association with hunting boots, each boot having a heel and a toe, the apparatus including at least two attachments, each comprising, in combination: a boot sleeve formed as a generally rectangular shaped box with an open top section and an open front section, the sleeve having a rounded rear wall, two rounded side walls and a bottom wall, each of the walls being formed contiguously with each other and including an inner lining and an outer lining, the outer lining including cushion material adapted to muffle the sounds normally made by a user's boots when walking, a user's boot being positionable within each sleeve, the heel of the user's boot being positioned against the rear wall and on top of the bottom wall, the toe of the user's boot being positioned through the open front section of the sleeve to enable the user to attain traction while stalking prey, the boot attachment causing a user's heel to make contact with the ground before the user's toe thereby facilitating the muffling of sound, the top section of the sleeve including a fold-over loop secured in place with stitching, the fold-over loop defining a tubular space therein, a long shoelace with two plastic coated free ends being positioned through the space in the fold-over loop, the plastic tips and adjacent portions of the shoe lace extending outwardly from the front section; and two sets of three generally U-shaped hooks being affixed to the upper extent of the side walls, one set of hooks being affixed in a spaced arrangement upon the upper extent of each side wall adjacent to the front section, each set of hooks being positioned in a parallel arrangement across from each other, in an operative orientation the shoelaces being coupled around the hooks in a crossed configuration thereby permitting users to quickly lace the attachments around a boot.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide new and improved cushioned boot attachment system for stalking game which has all of the advantages of the prior art boot accessories and none of the disadvantages.

It is another object of the present invention to provide new and improved cushioned boot attachment system for stalking game which may be easily and efficiently manufactured and marketed.

It is further object of the present invention to provide new and improved cushioned boot attachment system for stalking game which is of durable and reliable constructions.

An even further object of the present invention is to provide new and improved cushioned boot attachment system for stalking game which is susceptible of a low cost of manufacture with regard to both materials and labor, and which accordingly is then susceptible of low prices of sale to the consuming public, thereby making such cushioned boot attachment system for stalking game economically available to the buying public.

Still yet another object of the present invention is to provide new and improved cushioned boot attachment system for stalking game which provides in the apparatuses and methods of the prior art some of the advantages thereof, while simultaneously overcoming some of the disadvantages normally associated therewith.

Still another object of the present invention is to quietly stalking game by securing the sound muffling apparatus around the heel and sides of a hunter's boots.

Lastly, it is an object of the present invention to provide a new and improved cushioned boot attachment system for stalking game adapted for use in association with hunting boots, each boot having a heel and a toe, the apparatus including at least two attachments, each comprising: a boot sleeve formed in a generally box shaped configuration with an open top section, an open front section, and a rear wall, two side walls and a bottom wall, the walls being formed contiguously with each other and including a lining with cushioned material, a user's boot being positionable within each sleeve with the heel against the rear wall and the toe positioned through the open front section, the top section of the sleeve including a shoelace positioned therethrough, the top section including shoe lace coupling devices to facilitate tightening of the apparatus snugly around a user's feet.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts through the various Figures.

DESCRIPTION OF THE PREFERRED EMBODIMENT

Figure 1:
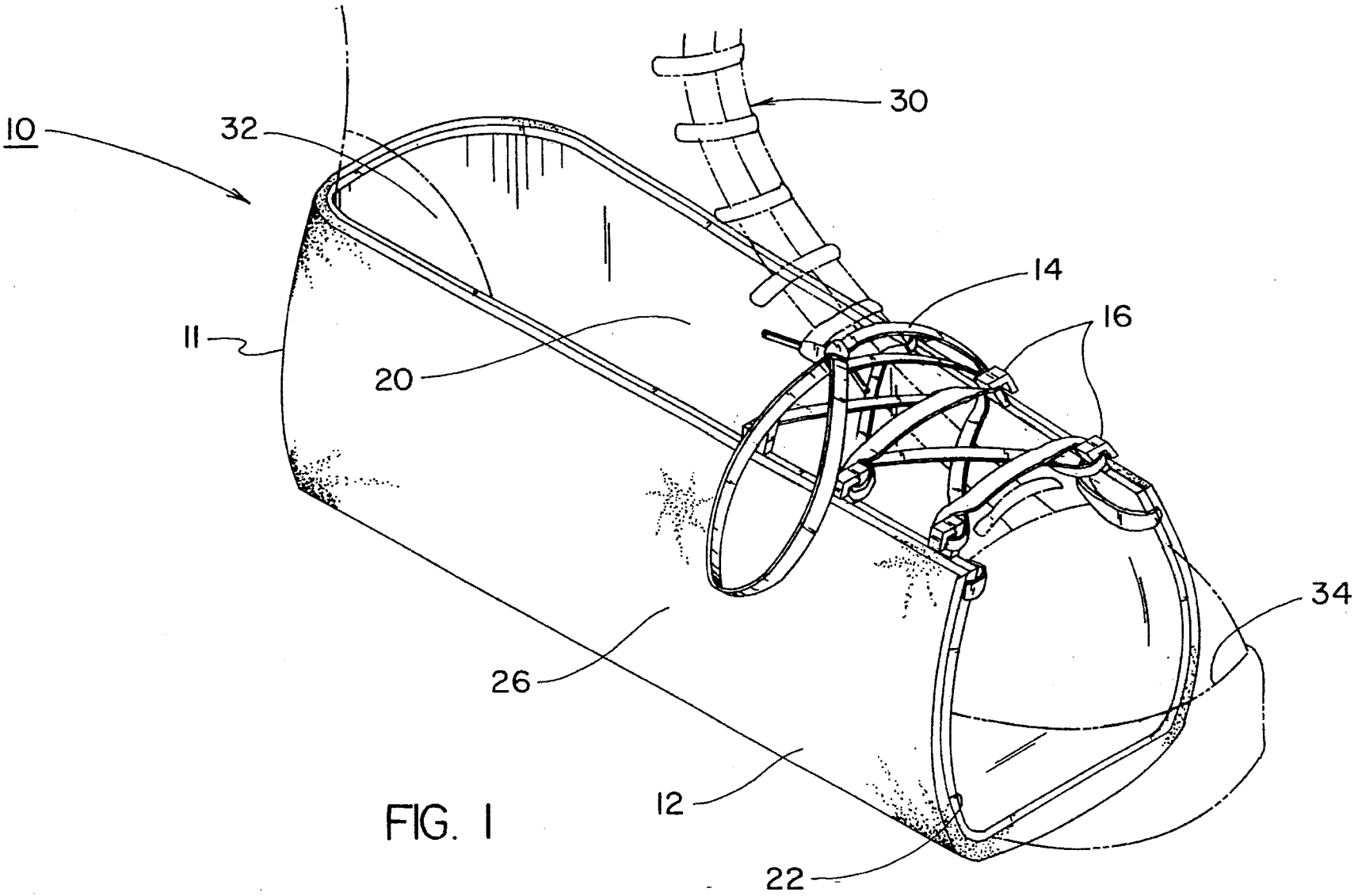
FIG. 1 is a perspective view of the preferred embodiment of the cushioned boot attachment system for stalking game constructed in accordance with the principles of the present invention.

With reference now to the drawings, and in particular to FIG. 1 thereof, the preferred embodiment of the new and improved cushioned boot attachment system for stalking game embodying the principles and concepts of the present invention and generally designated by the reference numeral 10 will be described.

The present invention, the cushioned boot attachment system for stalking game 10 is comprised of a plurality of components. Such components in their broadest context include a boot sleeve 12, a shoe lace 14 and two sets of three hooks 16. Such components are individually configured and correlated with respect to each other so as to attain the desired objective.

More specifically, the new and improved cushioned boot attachment system for stalking game is adapted for use in association with hunting boots 30. Each boot has a heel 32 and a toe 34. The apparatus includes at least two boot attachments 11. The attachments may be coupled to a plurality of different types of hunting boots. In alternative embodiments of the apparatus the boots are fabricated in a plurality of colors and sizes to accommodate the varying boot sizes of different users. Note FIG. 1.

Figure 3:
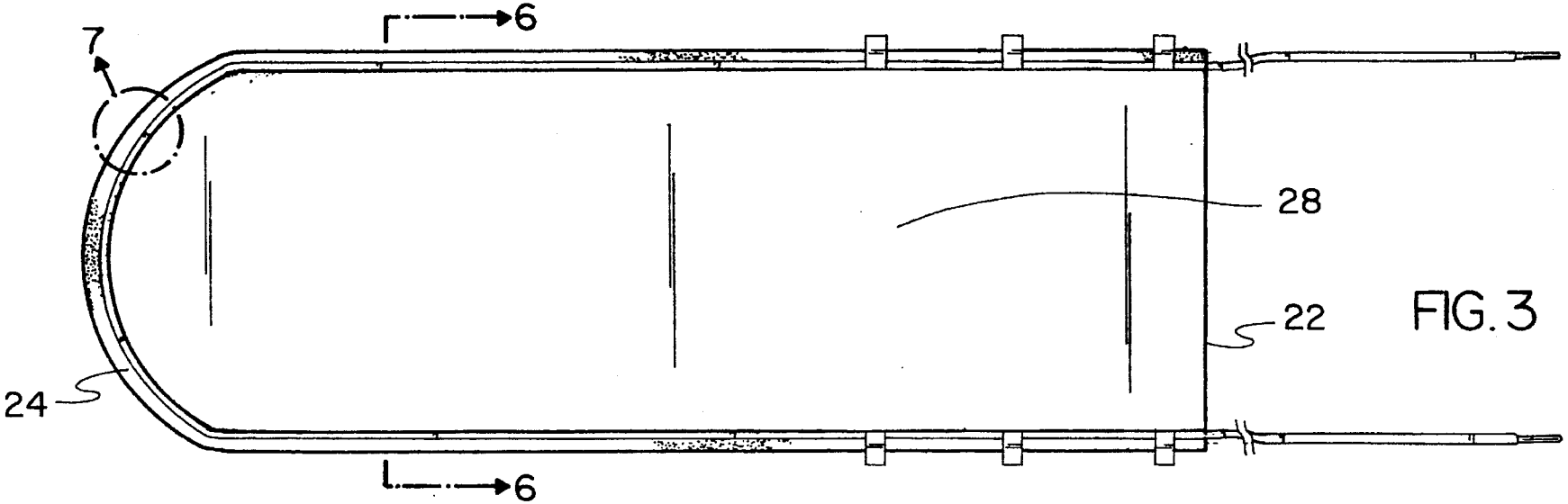
FIG. 3 is a top plan view of the apparatus shown in FIG. 1.
Figure 4:
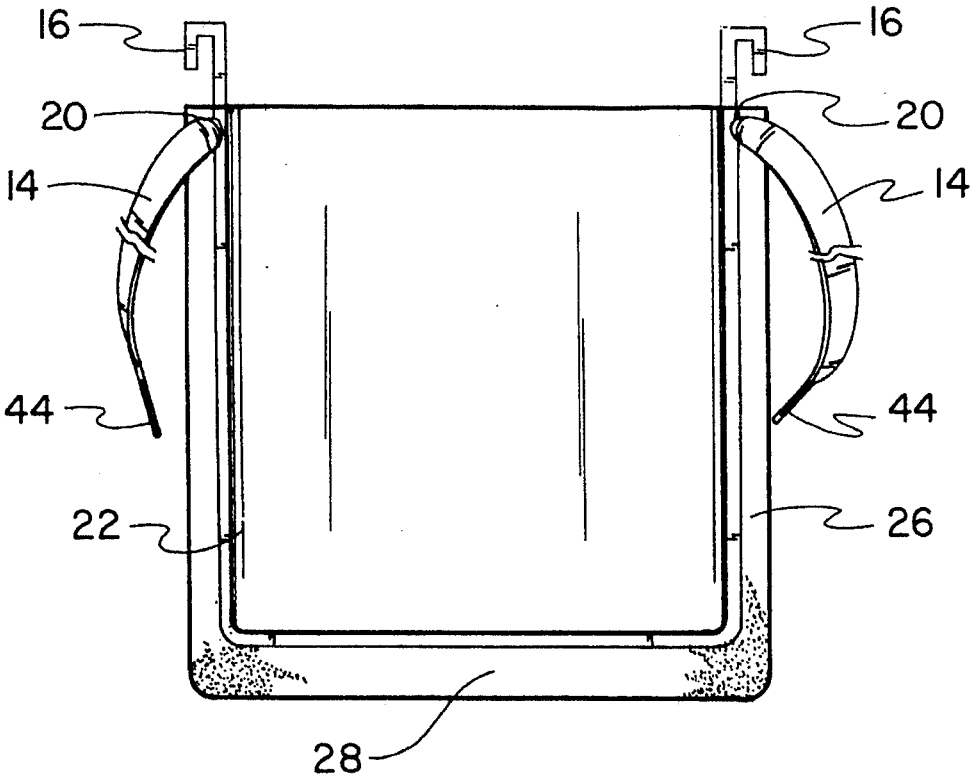
FIG. 4 is a front perspective illustration of the apparatus illustrating the positioning of the shoelace component.
Figure 5:
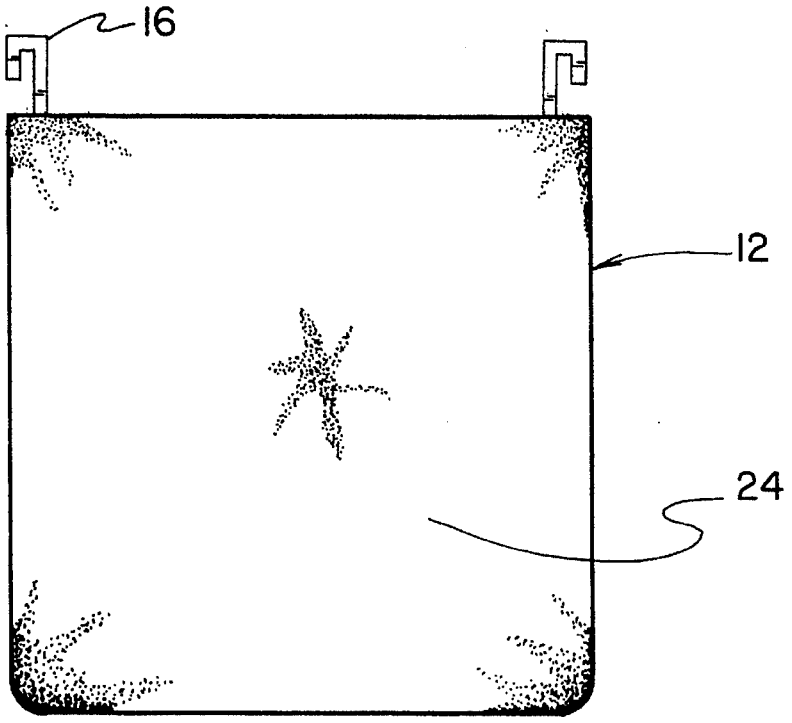
FIG. 5 is a rear perspective illustration of the apparatus illustrating the rear wall thereof.
Figure 6:
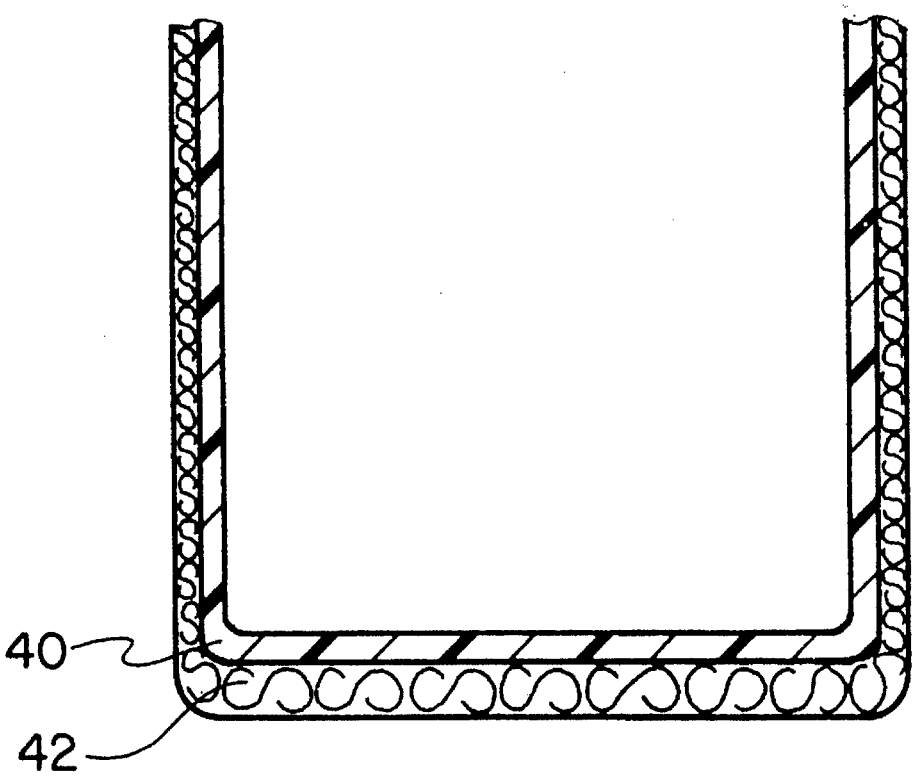
FIG. 6 is a cross sectional view of the apparatus taken along section line 6—6 of FIG. 3.
Figure 7:
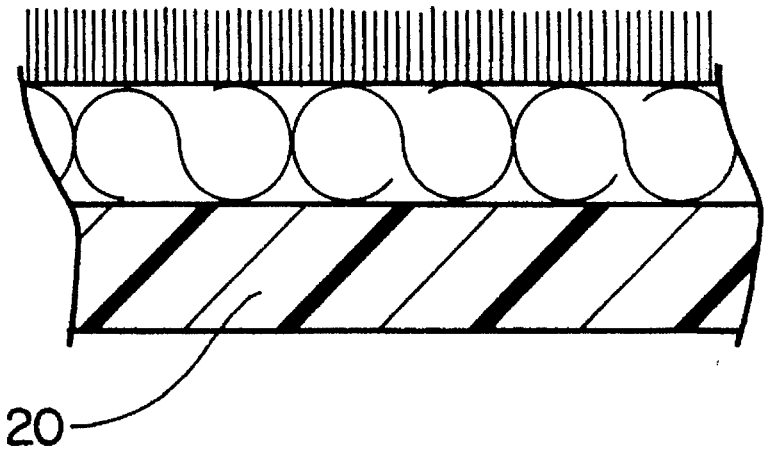
FIG. 7 is a cross sectional view of the apparatus taken along section line 7 of FIG. 5.

The apparatus includes at least two boot sleeves 12, one for each foot. Each boot sleeve is formed as a generally rectangular shaped box with an open top section 20 and an open front section 22. The sleeve has a rounded rear wall 24, two rounded side walls 26 and a bottom wall 28. The boot sleeves are formed of thick sturdy materials to withstand the forces applied to them during use. The sleeves may be fabricated of canvass, cloth or rug materials. Today's hunting public use scents to cover up human scent and/or lure game using specific scent lures. Hunters can apply both types of scents on the sleeves of the apparatus. Each of the walls are formed contiguously with each other and include an inner lining 40 and an outer lining 42. The outer lining includes cushion material adapted to muffle the sounds normally made by a user's boots when walking. The thick cushion material allows the hunter to quietly stalk game even when walking over twigs, etc. The cushion material may be formed of synthetic fibers or natural materials such as wool. Note FIGS. 1, 3 and 4.

A user's boot 30 is positionable within each sleeve. The heel 32 of the user's boot is positioned against the rear wall 24 and on top of the bottom wall 28. The toe 34 of the user's boot is positioned through the open front section of the sleeve to enable the user to attain traction while stalking prey. The boot attachment causes a user's heel to make contact with the ground before the toe thereby facilitating the muffling of sound when walking or stalking pray. The apparatus permits the user to snugly position it around his boot to prevent interference with walking and running. Note FIGS. 1 and 4.

A significant part of the art of hunting is stalking game. Trying to get close to the game without making any sound is hard. The cushioned boot attachment system 10 for stalking game includes at least two boot attachments 11. The attachments are adapted to fit on the bottom of a boot from the heel towards the toe, about three-quarters the length of the shoe sole. The attachments are shaped to fit the contour of the boot sole. With the shoe strings attached the user simply laces the over his boots to fit snugly and tightly on the bottom of the boot. During field stalking the user walks with the heel touching the ground first. The toe area is exposed to provide traction. For example, a user may easily follow game up a hill by gaining traction using the exposed toe area of the boot. The apparatus significantly muffles sound even over twigs that snap very loudly walked over without the boot attachments. Note FIG. 1, 3, 4 and 5.

Figure 2:
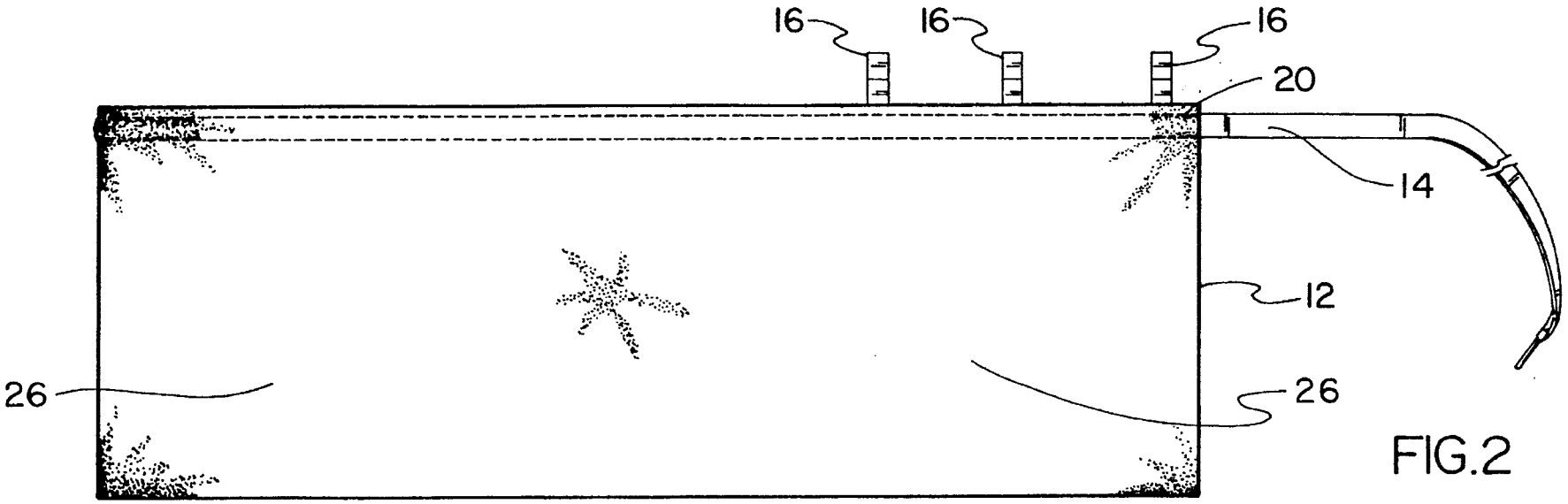
FIG. 2 is a side perspective illustration of the apparatus shown in FIG. 1.

The top section 20 of the sleeve includes a fold-over loop secured in place with stitching. The fold-over loop defines a tubular space within it. A long shoelace 14 with two plastic coated free ends 44 is positioned through the space in the fold-over loop. The plastic tips and adjacent portions of the shoe lace extend outwardly from the front section. The shoe lace is fabricated of sturdy synthetic fabric in the preferred embodiment. In alternative embodiments the shoe lace may be fabricated of cloth, leather, or other materials. The shoe lace is of a sufficient length to wrap around the entire perimeter of the top section and extend several inches outside the front section. The shoe lace enables the user to tighten the sleeve around his boot. Note FIGS. 2, 3 and 4.

Two sets of three generally U-shaped hooks 16 are affixed to the upper extent of the side walls. The hooks are fabricated of metal in the preferred embodiment. In alternative embodiments the hooks may be fabricated of plastic or other synthetic materials. In further alternative embodiments loops are utilized instead of hooks. One set of hooks is affixed in a spaced arrangement upon the upper extent of each side wall adjacent to the front section. Each set of hooks 16 is positioned in a parallel arrangement across from each other. In an operative orientation the shoelaces are coupled around the hooks in a crossed configuration thereby permitting users to quickly lace the attachments around a boot. The hooks enable the user to quickly secure the sleeves around his boot. Time is an important factor when putting the attachments on one's boots. When stalking game one surveys the land and considers the amount of time to get to a certain point ahead of the game. The hooked lacing configuration of the apparatus it takes less time to put the sleeves on. The user may then travel quietly to the desired spot without frightening the stalked game off. Note FIGS. 1–3.

The cushioned boot attachment system for stalking game is a simple device which consists of a heavy duty thick material which wraps around the heel portion and sides of a hunter's boots. The sleeve covers the sole and sides of the hunter's boots, the sleeve is contoured to fit snugly around the boot, leaving the toe area exposed for traction while climbing uphill, etc. Hooks are located along the top end of the sleeve to enable a user to secure the shoelace to the boots. The sleeves may be produced from weather resistant synthetic materials in various sizes and colors.

The attachments are positioned beneath the hunter's boots so that they cover the heel portion of the footwear, including the sole and the sides of the boot. They are then secured in place by tightly lacing the shoelaces. When properly worn, the attachments cover approximately ¾ of the boot sole, leaving the toe area uncovered. Since normal walking strides include heel to toe movements, the thick coverings muffle the sounds beneath the boots, enabling the hunter to effectively accomplish successful stalking maneuvers. These simple hunting accessories enable the hunter to quietly walk through brush and other natural surroundings while also providing him/her with necessary traction when climbing or walking uphill.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A new and improved cushioned boot attachment system for stalking game adapted for use in association with hunting boots, each boot having a heel and a toe, the apparatus including at least two attachments, each comprising, in combination:

a boot sleeve formed as a generally rectangular shaped box with an open top section and an open front section, the sleeve having a rounded rear wall, two rounded side walls and a bottom wall, each of the walls being formed contiguously with each other and including an inner lining and an outer lining, the outer lining including cushion material adapted to muffle the sounds normally made by a user's boots when walking, the top section of the sleeve including a fold-over loop secured in place with stitching, the fold-over loop defining a tubular space therein, a long shoelace with two plastic coated free ends being positioned through the space in the fold-over loop, the plastic tips and adjacent portions of the shoe lace extending outwardly from the front section; and two sets of three generally U-shaped hooks being affixed to the upper extent of the side walls, one set of hooks being affixed in a spaced arrangement upon the upper extent of each side wall adjacent to the front section, each set of hooks being positioned in a parallel arrangement across from each other, in an operative orientation the shoelaces being coupled around the hooks in a crossed configuration thereby permitting users to quickly lace the attachments around a boot.

2. A cushioned boot attachment system for stalking game adapted for use in association with hunting boots, each boot having a heel and a toe, the apparatus including at least two attachments, each comprising:

a boot sleeve formed in a generally box shaped configuration with an open top section, an open front section, and a rear wall, two side walls and a bottom wall, the walls of each sleeve including a solid inner lining and a solid outer lining, the outer lining including cushion material adapted to muffle the sounds normally made by a user's boots when walking, the top section of the sleeve including a shoelace with two plastic coated free ends positioned therethrough, the top section including two sets of three generally U-shaped hooks being affixed to the upper extent of the side walls, a set of hooks being affixed in a spaced arrangement upon the upper extent of each side wall adjacent to the front section, each set of hooks being positioned in a parallel arrangement across each other, in an operative orientation the shoelaces being coupled around the hooks in a crossed configuration thereby permitting users to quickly lace the attachments around a boot.

* * * * *